United States Patent [19]

Joffe

[11] Patent Number: 4,884,854

[45] Date of Patent: Dec. 5, 1989

[54] INTERCONNECTING PANELS FOR KNOCKDOWN STRUCTURES

[76] Inventor: Edward J. Joffe, 940 Park Ave., Linden, N.J. 07036

[21] Appl. No.: 324,464

[22] Filed: Mar. 16, 1989

[51] Int. Cl.[4] ..... A47B 58/00

[52] U.S. Cl. ..... 312/257.1; 312/263

[58] Field of Search ..... 312/263, 257 SM, 257 SK, 312/257 R, 140

[56] References Cited

U.S. PATENT DOCUMENTS

| | | | |
|---|---|---|---|
| 3,854,783 | 12/1974 | Teranishi | 312/257 R |
| 3,917,757 | 11/1975 | Hoag | 312/263 |
| 3,995,922 | 12/1976 | Ohashi | 312/257 R |
| 4,295,693 | 10/1981 | Viklund | 312/257 R |
| 4,296,983 | 10/1981 | Rogers et al. | 312/263 |

*Primary Examiner*—Joseph Falk

*Attorney, Agent, or Firm*—Peter L. Klempay

[57] ABSTRACT

Panels for forming the four sides of knockdown constructions such as file cabinets or shelf units are formed with interlocking side rails allowing for assembly without the use of separate fasteners or tools.

7 Claims, 5 Drawing Sheets

FIG. 9
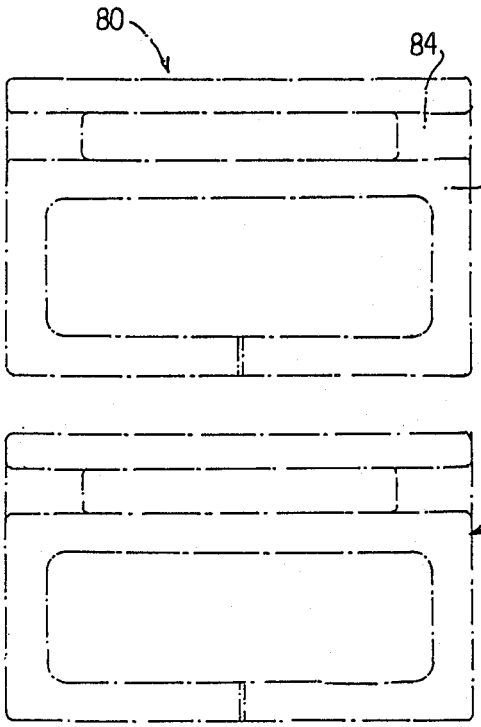
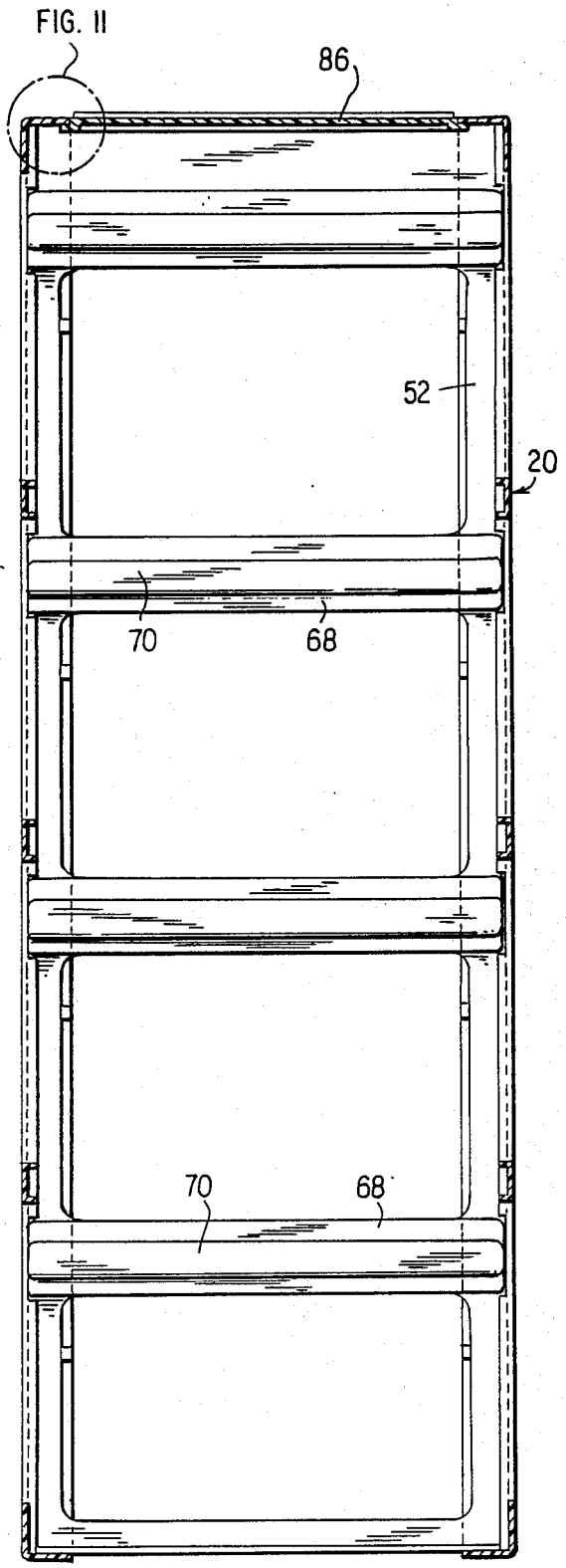
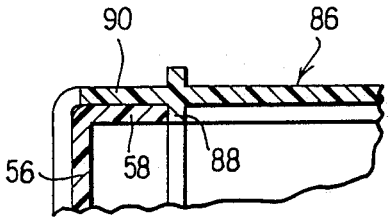
FIG. 10
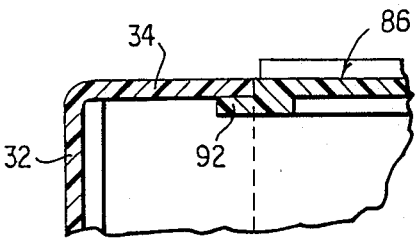
FIG. 11

INTERCONNECTING PANELS FOR KNOCKDOWN STRUCTURES

The present invention pertains to knockdown or collapsible structures such as cabinet frames and bins and, more particularly, to such structures of molded plastic construction

CROSS-REFERENCE TO RELATED APPLICATIONS

My copending application Ser. No. 324465, filed concurrently herewith, entitled KNOCKDOWN DRAWERS AND BINS, discloses drawer constructions adapted for use with the frames of the present invention.

BACKGROUND OF THE INVENTION

The use of knockdown construction in various furniture items such as shelving, filing cabinets and storage bins is advantageous as such construction permits the compact storage and shipping of the items. A wide variety of interconnecting arrangements for the components making up a knockdown cabinet or the like have been devised. Many of these arrangements, however, involve the use of separate fasteners, adding both to the cost of the unit and to the complexity of its assembly by, for example, requiring the use of tools such as screwdrivers and wrenches or pliers.

It is the primary object of the present invention to provide components for knockdown furniture such as file cabinets which components include integral connectors.

It is also an object of the present invention to provide such knockdown furniture components which are interconnected without the use of tools.

A further object of the invention is the provision of such knockdown furniture components of molded plastic fabrication.

SUMMARY OF THE INVENTION

The above and other objects of the present invention which will become apparent hereinafter are achieved by the provision of knockdown furniture components which include a pair of first frames forming, for example, the front and rear portions of a file cabinet; and a pair of second frames or panels forming, for example, the two sides of the cabinet; each lateral edge of each first frame having a first wall extending the length thereof in the principal plane of the panel, a second wall extending perpendicular to the first wall at the lateral edge thereof and having, at spaced intervals therealong at the outer edge thereof, wedge-shaped projections, a third wall extending in spaced parallel relation to the second wall; and each lateral edge of each second panel having a first wall extending the length thereof in the principal plane of the panel and of a width substantially equal to the distance between the juncture of the first and second walls of the first frame and the wedge-shaped projections, and a second wall extending perpendicular to the first wall and of a length substantially equal to the distance between the second and third walls of the first frame. The frames and panels are molded of plastic material having sufficient resiliency as to permit the lateral edge of a panel to be inserted into the lateral edge of a first frame with the wedgeshaped projection engaging the inner edge of the first wall of the panel. When the frames and panels of the invention are used to form a file cabinet, the first frames include transverse bars extending between the two lateral edges thereof and defining drawer openings while the second panels include transverse bars extending between the lateral edges thereof and having inwardly directed projecting portions forming drawer guides. A top panel supported by the upper ends of the frames and panels may also be provided.

For a more complete understanding of the invention and the objects and advantages thereof, reference should be had to the accompanying drawings and the following detailed description wherein a preferred embodiment of the invention is illustrated and described.

DESCRIPTION OF THE DRAWINGS

In the drawings:

FIGS. 8 and 9 are transverse cross sectional views taken on the lines 8—8 and 9—9, respectively, a FIG. 6; and FIGS. 10 and 11 are fragmentary cross sectional views corresponding to the circled portions of FIGS. 8 and 9, respectively, and on an enlarged scale relative thereto.

p DESCRIPTION OF THE PREFERRED EMBODIMENT

In the following description of the preferred embodiment, the knockdown components of the present invention are illustrated as forming the frame of a filing cabinet or set of drawers. It will be apparent, however, that the manner of interconnecting the components is readily adaptable to a wide variety of different knockdown structures including shelving and storage bins.

Figure 1:
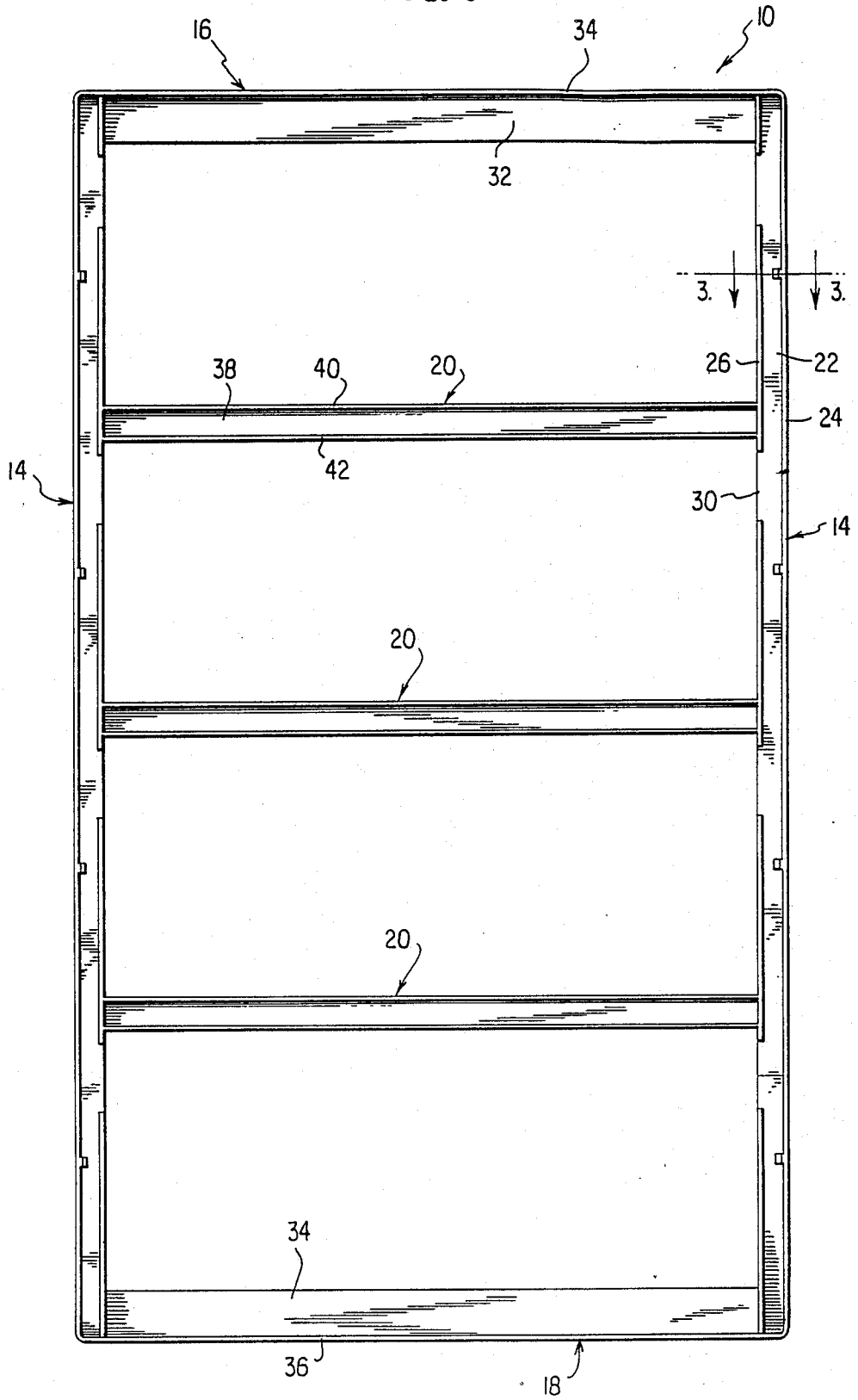
FIG. 1 is an elevational view of a first frame used in forming a knockdown file cabinet.
Figure 2:
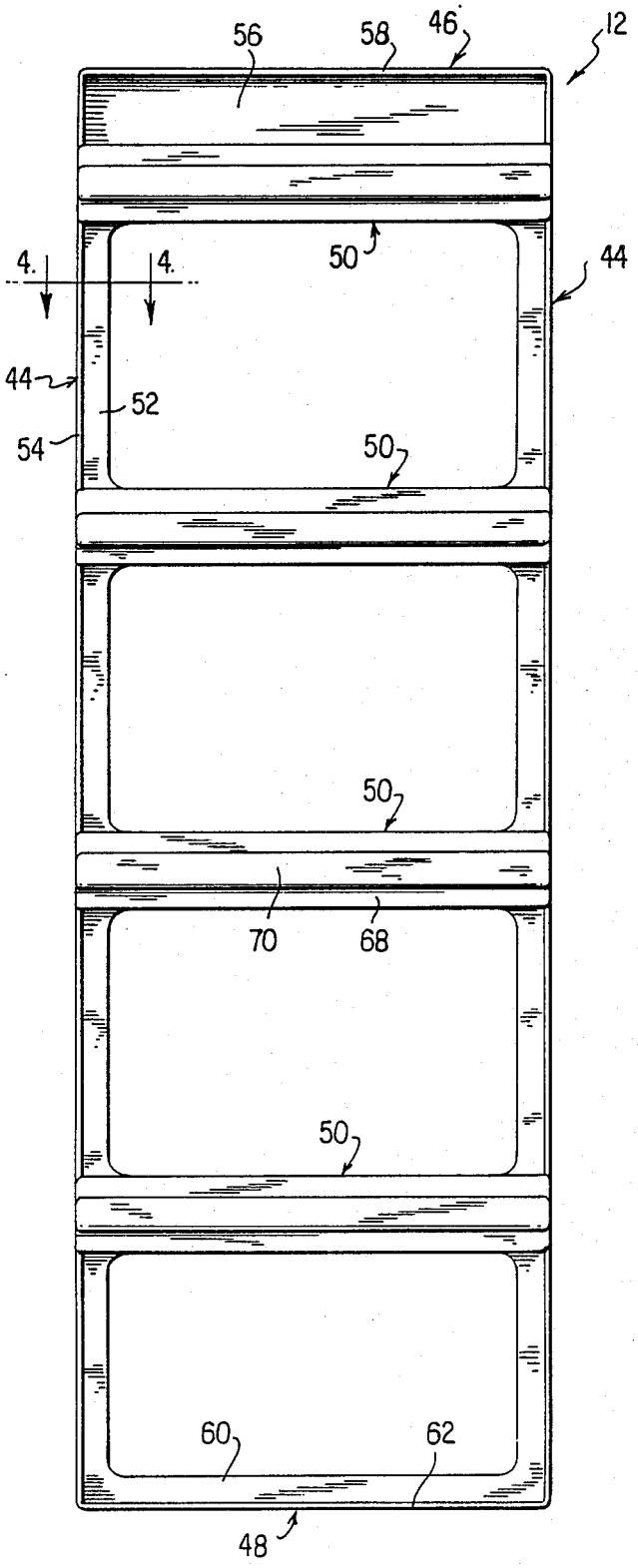
FIG. 2 is a elevational view of a second frame or panel used in forming a knockdown file cabinet.
Figure 3:
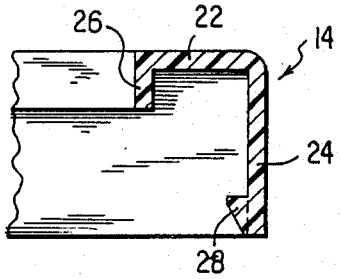
FIG. 3 is a fragmentary cross sectional view taken on the line 3—3 of FIG. 1.
Figure 4:
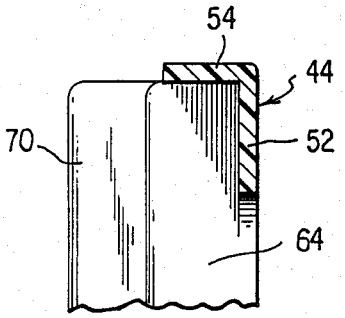
FIG. 4 is a fragmentary cross sectional view taken on the line 4—4 of FIG. 2.

The basic knockdown frame assembly consists of a pair of first frame members designated generally by the reference numeral 10 and illustrated in FIGS. 1 and 3 and a pair of second frame or panel members designated generally by the reference numeral 12 and illustrated in FIGS. 2 and 4. For convenience in describing the assembly, the frame members 10 are referred to as front or rear frame members while the frame members 12 are referred to as side panel members. The two frame or panel members of each pair are identical to one another.

The front or rear frame member 10, which is a unitary molded plastic member, has a pair of side rails 14 which are mirror images of one another, top and bottom rails 16 and 18, respectively, connecting the side rails at the ends thereof, and one or more intermediate rails 20 also connecting the side rails. As can be seen most clearly in FIG. 3, each side rail 14 has a first planar wall 22 extending parallel to the principal plane of the frame member, a second planar wall 24 extending perpendicular to the first wall 22 at the lateral edge thereof, and a third planar wall 26 also extending perpendicular to the first wall and in spaced parallel relation to the second wall. At intervals, preferably uniformly spaced, along the outer edge of the second wall 24, wedge-shaped projections 28 are provided. The third wall 26 may be discontinuous, having gaps 30 at intervals the length thereof.

The top rail 16, preferably, has a front wall 32 which is an extension of the first wall 22 of the side rail 14 and a to wall 34 of the same width as the second wall 24. Likewise, the bottom rail 18 is, preferably, of L-shaped cross sectional configuration with a front wall 34 and bottom wall 36. The intermediate rails 20 may be of U-shaped cross sectional configuration with a front wall 38, top wall 40 and bottom wall 42 with the top and bottom walls being of the same width as the third wall 26 of the side rail 14.

Each side panel member 12, also a unitary molded plastic construction, has a pair of mirror image side rails 44, a top rail 46, bottom rail 48, and one or more intermediate rails 50. Each of these side rails includes a first planar wall 52 extending parallel to the principal plane of the member 12 and of a width substantially equal to the distance between the juncture of a first and second walls 22, 24 of the side rail of the first member 10 and the inner face of the wedge-shaped projection and a second planar wall 54 extending perpendicular to the first wall 52 at the lateral edge thereof and of a width substantially equal to the distance between the second and third walls 24, 26 of the side rail 14.

Figure 8:
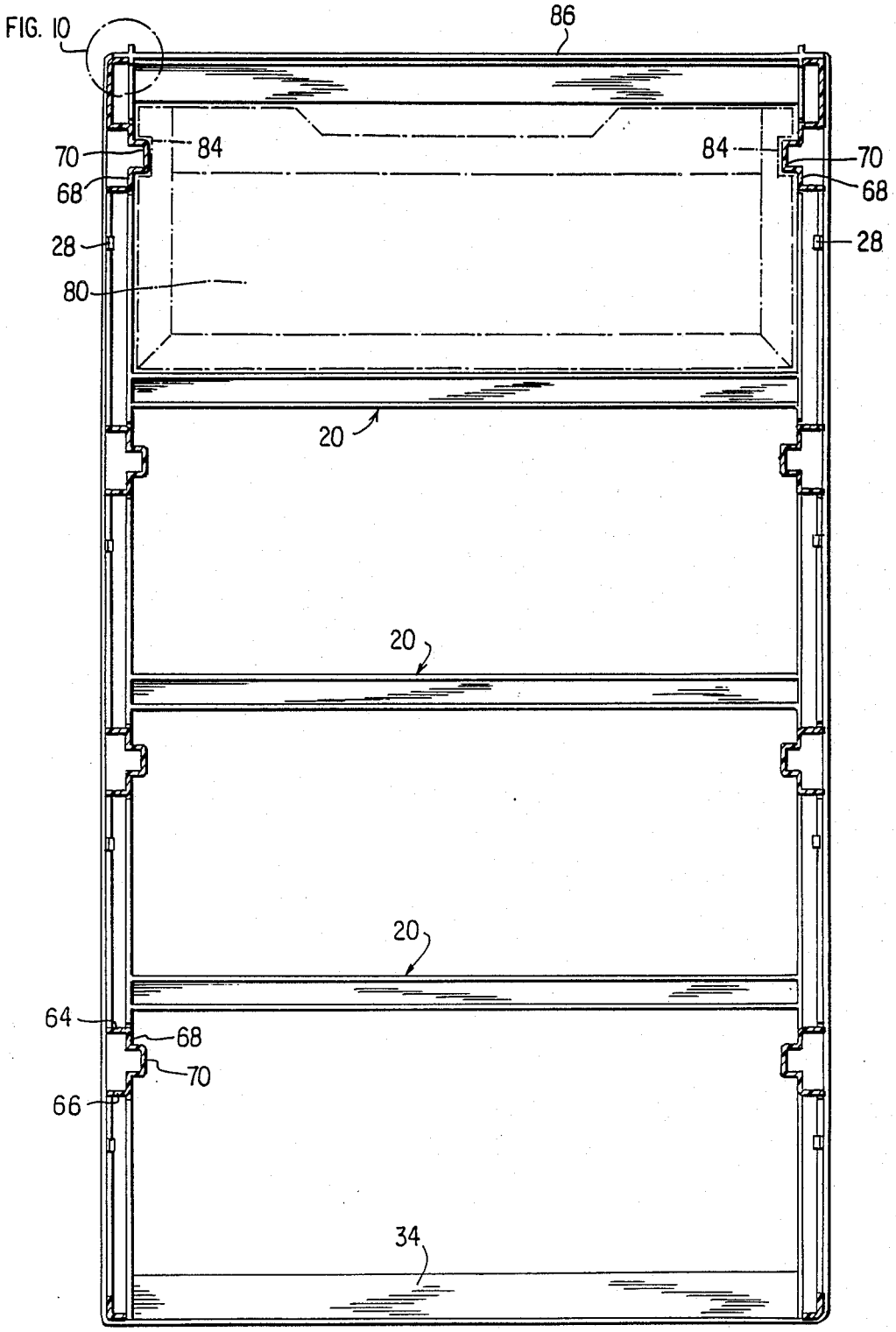

The top and bottom rails 46, 48 of the panel member 12, preferably, include front walls 56, 60 and top and bottom walls 58, 62, respectively. The intermediate rails 50 may be of the same configuration as the rails 20 of the first frame member 10. However, in the illustrated embodiment of a filing cabinet frame, the intermediate rails 50, as can be seen in FIG. 8, include upper and lower horizontal walls 64, 66 projecting inwardly from the outer face of the frame member 12, vertical wall sections 68 at the inner ends of the walls 64, 66 and a central U-shaped wall 70 projecting inwardly from the sections 68, the U-shaped wall extending inwardly of the side rails 14 and 44 to form drawer-carrying rails. When this configuration of the intermediate rails 50 is used, the gaps 30 of the third or inner wall 26 of the first frame member 10 are located so as to provide clearance for the rails 50.

Figure 5:
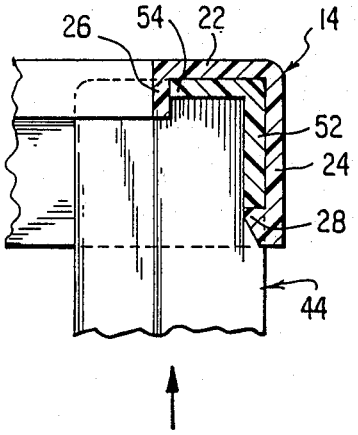
FIG. 5 is a fragmentary cross sectional view showing the manner in which the frames and panels are interconnected.
Figure 6:
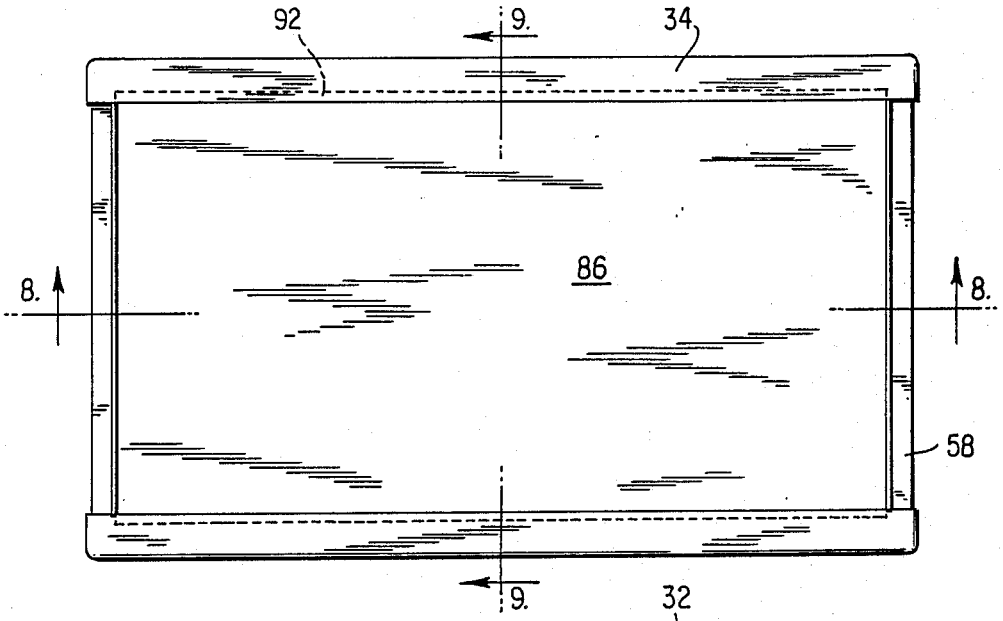
FIG. 6 is a top plan view of a knockdown file cabinet formed of the frames and panels of FIGS. 1 and 2.
Figure 7:
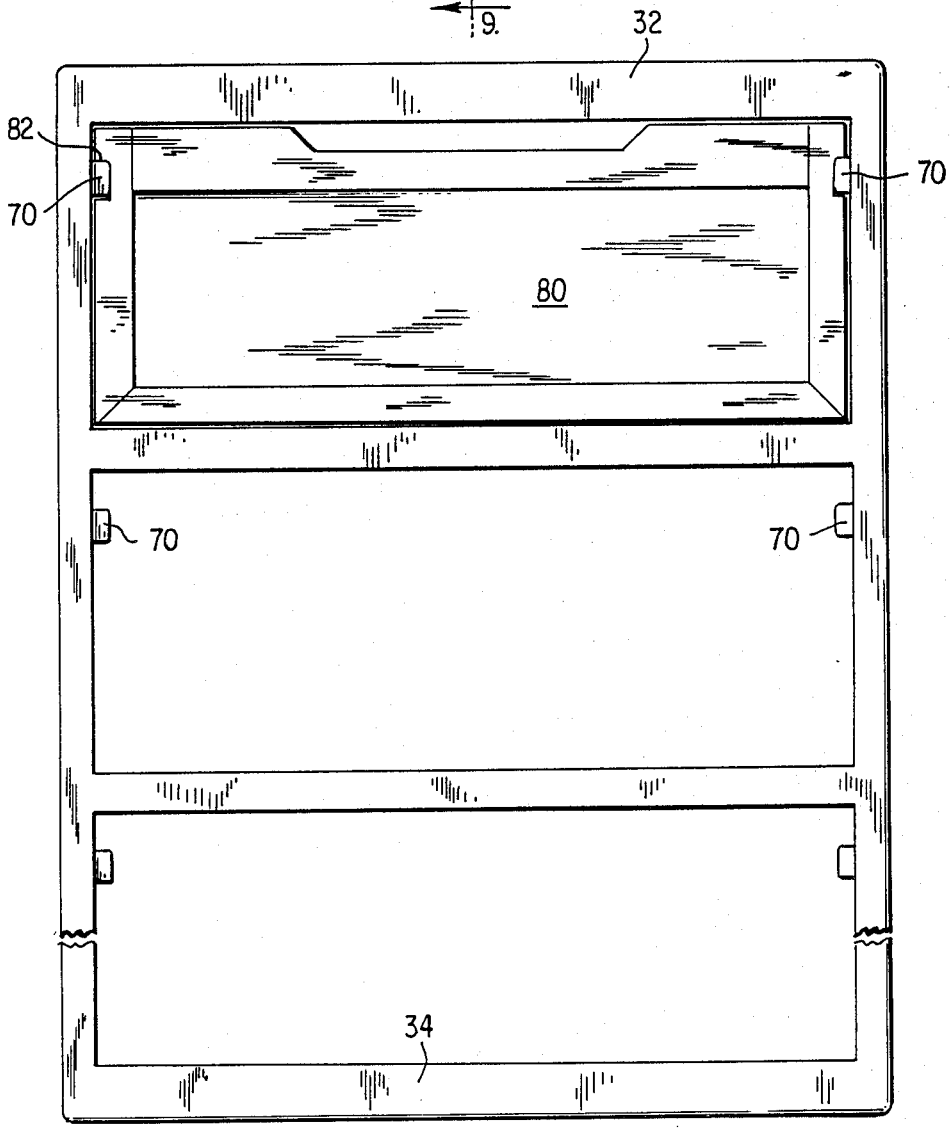
FIG. 7 is a elevational view of the file cabinet.

Assembly of the frame and panel members to form a complete frame involves positioning a first frame member 10 on a flat surface with the side rail walls 24 and 26 extending upwardly, positioning a vertically oriented panel member 12 over the first frame member and in alignment with one of the side rails 14 thereof, and pressing downwardly on the panel member to bring the side wall 54 of the panel member side rail 44 into abutting relation with the front wall of the first frame member side rail 14 and the front wall 52 into abutting relation with the first side wall 28, as is shown in FIG. 5. The walls 28 and 52 have sufficient resiliency as to allow flexing thereof to permit the wedge-shaped projections 28 to ride over the outer surface of the wall 52 during insertion of the rail 44 into the confines of the rail 14. When the rail 44 is fully inserted, the wedge-shaped projections engage the lateral edge of the wall 52, thus retaining the frame members 10 and 12 together. The same procedure is followed to connect the other of the panel members 12 to the opposite side rail of the first frame member 10. Thereafter, the other of the first frame members 10 is placed in alignment with the free side rails 44 of the two panel members and pressed downwardly thereon to complete the basic frame structure. The overall height of the panel members 12 is less than that of the first frame members 10 by approximately the combined thicknesses of the first frame member top and bottom walls 58 and 62 to permit the panel members to be received within the side rails of the first frame members.

As is shown in FIGS. 7–11, the assembled frame is provided with drawers 80 to form a storage or file cabinet. Each side wall 82 of the drawers is formed with an inwardly extending channel or recess extending the depth of the drawer into which the U-shaped walls 70 of the panel member intermediate rails 50 project to support the drawers in the frame. The drawers 80 may be of the type disclosed in my above-references copending application Ser. No. 324465, filed concurrently herewith and entitled KNOCKDOWN DRAWERS AND BINS.

Completing the description of the knockdown file cabinet, a cover plate 86 is provided to close the top of the cabinet. The two lateral edges 90 of the plate overly the top walls 58 of the side frame member top rails 46, the plate including downwardly extending ribs 88 which abut the inner lateral edges of the top walls 58. The front and rear edges of the plate have downwardly offset flanges 92 which underly the top walls 34 of the first frame member top rails 16. Cover plate is installed by slightly bowing the same to permit the flanges 92 to be slid under the walls 34.

It will be apparent that the knockdown components may be of other configurations than those of the above described embodiment. For example, in a knockdown shelving assembly, the side panel intermediate rails corresponding to the rails 50 would, preferably, be relocated so as to support the shelves in alignment with the front and rear frame intermediate rails corresponding to the rails 20. One or more of the frames of panels may also be formed with a solid wall extending between the side rails thereof in place of the intermediate rails. Side panels of solid wall contruction are provided with openings in alignment with the locking projections or tabs 28 of the mating front and rear frame members.

As these and other changes and additions may be made in the described embodiment of the invention without departing from the spirit thereof, reference should be had to the appended claims in determining the true scope of the invention.

I claim:

1. A knockdown cabinet construction of the type having a set of first frame members forming two opposite sides of the cabinet and, detachably connectable thereto, a set of second frame members forming two other opposite sides of the cabinet, each of the first and second frame members having a principal face forming the corresponding cabinet side, characterized in that:

each first frame member includes a pair of side rails extending the height thereof, each side rail having a first planar wall extending in the principal face of said member, a second planar wall extending perpendicular to said first wall at the lateral edge thereof, a third planar wall extending perpendicular to said first wall and in spaced parallel relation to said second wall, said second wall having a plurality of wedge-shaped projections at spaced intervals at the free lateral edge thereof and extending toward said third wall; and each second frame member includes a pair of second side rails extending the height thereof, each of said lastmentioned side rails having a first planar wall extending in the principal face of said second frame member and of a width substantially equal to the distance between the juncture of said firstmentioned first and second walls and said projections, and a second planar wall extending perpendicular to said second frame member first wall and of a width substantially equal to the distance between said firstmentioned second and third walls;

the arrangement being such that said second frame member side rail is insertable into said first frame member side rail and retained therein by engagement of said second side rail second walls between said aforementioned side rail second and third walls and abutting said frame member first wall and by engagement of said projections with the free lateral edge of said second side rail first wall.

2. The knockdown furniture construction of claim 1 wherein each of said frame members includes a top rail, a bottom rail and a plurality of intermediate rails at spaced intervals between said top and bottom rails, each of said rails being connected to and extending between said side rails of said frame member; and each of said panel members includes a top rail, a bottom rail and a plurality of intermediate rails at spaced intervals between said last mentioned top and bottom rails, each of said panel member rails being connected to and extending between said side rails of said panel member.

3. The knockdown furniture construction of claim 2 wherein each of said panel member intermediate rails includes a wall portion projecting, in an assembled frame comprised of said frame and panel members, inwardly.

4. The knockdown furniture construction of claim 3 further characterized in that said panel member intermediate rails are offset along the height of said member relative to said frame member intermediate rails.

5. The knockdown cabinet construction of claim 1 further characterized in that each of said first and second frame members is of unitary molded plastic construction.

6. First and second panels which are detachably interconnectable to form, with a like set of panels, the front, rear and sides of a knockdown cabinet, each of the first and second panels having a principal face forming the corresponding cabinet wall, characterized in that:

said first panel includes a side rail extending the height thereof, said side rail having a first planar wall extending in the principal plane of said panel, a second planar wall extending perpendicular to said first wall at the lateral edge thereof, and a third planar wall extending perpendicular to said first wall in spaced parallel relation to said second wall, said second wall having a plurality of wedge-shaped projections at the free lateral edge thereof and extending toward said third wall; and said second panel includes a side rail extending the height thereof, said second panel side rail having a first planar wall extending in the principal face of said second panel and of a width substantially equal to the distance between the juncture between said firstmentioned first and second walls and said projections, and a second planar wall extending perpendicular to said second panel first wall at the lateral edge thereof and of a width substantially equal to the distance between said firstmentioned second and third walls;

the arrangement being such that said second panel side rail is insertable into said first panel member side rail and retained therein by engagement of said second side rail second wall between said firstmentioned side rail second and third walls and abutting said first panel first wall and by engagement of said projections with the free lateral edge of said side rail first wall.

7. The panels of claim 6 further characterized in that each of said panels is of unitary molded plastic construction.

* * * * *